US005246137A

United States Patent [19]

Schutz et al.

[11] Patent Number: 5,246,137

[45] Date of Patent: Sep. 21, 1993

[54] CENTER-PULL ROLL PRODUCT DISPENSER WITH NOZZLE INSERTS

[75] Inventors: Rudolph W. Schutz, Walnut Creek; Lawrence E. Weinert, Antioch, both of Calif.

[73] Assignee: James River Paper Company, Inc., Richmond, Va.

[21] Appl. No.: 925,204

[22] Filed: Aug. 6, 1992

[51] Int. Cl.[5] ..... A47K 10/24

[52] U.S. Cl. ..... 221/44; 221/63; 206/409

[58] Field of Search ..... 221/63, 44, 46, 48, 221/45; 206/210, 409, 410, 494, 205; 222/567, 569

[56] References Cited

U.S. PATENT DOCUMENTS

| | | | |
|---|---|---|---|
| 4,171,047 | 10/1979 | Doyle et al. | 206/210 |
| 4,180,160 | 12/1979 | Ogawa et al. | 206/210 |
| 4,219,129 | 8/1980 | Sedgwick | 221/63 |
| 4,262,816 | 4/1981 | Margulies | 221/46 |
| 4,534,491 | 8/1985 | Norton et al. | 221/63 |
| 4,648,530 | 3/1987 | Granger | 221/34 |
| 4,651,895 | 3/1987 | Niske et al. | 221/63 |
| 4,905,868 | 3/1990 | Beane et al. | 221/44 |

*Primary Examiner*—Robert P. Olszewski
*Assistant Examiner*—Kenneth Noland
*Attorney, Agent, or Firm*—Thomas R. Lampe

[57] ABSTRACT

Apparatus for dispensing individual sheets from the center of a coreless roll includes a support for supporting the coreless roll which defines an aperture, a dispenser nozzle defining a restricted passageway leading from the aperture, the nozzle having an exit opening, and an insert positioned in the passageway to change the effective size and the configuration of the dispenser nozzle.

11 Claims, 2 Drawing Sheets

CENTER-PULL ROLL PRODUCT DISPENSER WITH NOZZLE INSERTS

TECHNICAL FIELD

This invention relates to the dispensing of sheet material, and more particularly, to apparatus for dispensing individual sheets, such as paper towels, from the center of a coreless roll comprised of a plurality of the sheets.

BACKGROUND ART

A number of dispensers exist in the prior art for dispensing paper toweling and the like. Some of these dispensers are of the "center-pull" type wherein a web of toweling or other sheet material is pulled from the center of a coreless roll through a nozzle or other restrictor element forming a restricted passageway. Assuming that the individual sheets of toweling or the like are connected by perforated lines, as is common, the nozzle or other restrictor element will resist pulling of the sheet material by the user, thus breaking an individual sheet from the remaining web along the perforated line interconnecting same. U.S. Pat. No. 4,905,868, issued Mar. 6, 1990, illustrates a representative paper towel dispenser of the type just described.

U.S. Pat. No. 4,905,868 teaches the use of a conical funnel having a exit hole larger than the entrance hole thereof which provides an exit for paper towels being dispensed. The entrance opening and exit opening of the conical funnel are dimensioned such that a first paper towel will separate from a following paper towel along the perforation boundary therebetween when a leading portion of the following paper towel exits from the exit opening in the funnel.

Paper towels are made available with widely differing physical characteristics. For example, paper towels are manufactured and sold having different basis weights, bulks, tear strengths, and physical dimensions such as thickness. It has been found that a single nozzle or funnel size does not allow or provide for efficient dispensing of all towels. Paper toweling having a certain physical characteristic might dispense and tear properly after passing through the nozzle while paper toweling falling within a different physical characteristic range may not dispense properly.

U.S. Pat. No. 4,905,868 recognizes the fact that some nozzle adjustment must be made to accommodate a wide variety of paper towels. In the patent an attempt is made to solve the problem by providing the exit portion of the funnel or nozzle with one or more narrow neck portions which may be removed (by cutting, clipping, or breaking, etc.) in order to adjust the inside diameter of the nozzle exit opening. That is, detachable sections are included at the end of the nozzle of U.S. Pat. No. 4,905,868 to accommodate different sizes and thicknesses of paper towels used. The patent also makes a general statement to the effect that "varying" of the exit opening may be accomplished with "adjustable structure such as a collapsible funnel which may be moved to increase or decrease" the opening and then "locked into place." There is no teaching of such adjustable structure.

U.S. Pat. No. 4,905,868 merely addresses the matter of changing the size of the nozzle exit opening. It has been found that merely changing the size of the exit opening will not in all cases modify the nozzle sufficiently to adapt it to use with a wide variety of towels. Furthermore, in the embodiment of the invention disclosed in the patent, cut portions of the nozzle, once removed, are gone permanently and cannot be reattached. Thus, once the nozzle has been severed to accommodate one type of towel it cannot again be used efficiently with another type of towel calling for a smaller nozzle exit opening and longer nozzle.

The following patents are also known: U.S. Pat. No. 4,262,816, issued Nov. 21, 1981, U.S. Pat. No. 4,651,895, issued Mar. 24, 1987, U.S. Pat. No. 4,648,530, issued Mar. 10, 1987, U.S. Pat. No. 4,534,491, issued Aug. 13, 1985, U.S. Pat. No. 4,219,129, issued Aug. 26, 1980, U.S. Pat. No. 4,171,047, issued Oct. 16, 1979, and U.S. Pat. No. 4,180,160, issued Dec. 25, 1979. The patents just listed disclose various dispensing devices for dispensing sheet material, such as towelettes. The patents disclose various types of restrictors for separating individual sheets when pulled by a user. One of the patents, U.S. Pat. No. 4,651,895, discloses the concept of employing different dispensing aperture shapes.

DISCLOSURE OF INVENTION

The present invention relates to apparatus for dispensing individual sheets from the center of a coreless roll comprised of a plurality of said sheets forming a wound web having a lead end and a tail end, said lead end projecting outwardly from the roll center. The apparatus includes support means for supporting the coreless roll, the support means defining an aperture for receiving the lead end.

A dispenser nozzle is connected to the support means and has an inner nozzle wall defining a passageway leading from the aperture away from the support means. The dispenser nozzle has a distal end and the inner nozzle wall has at least a portion thereof defining a generally truncated cone-like configuration and converging to an exit opening defined by the dispenser nozzle distal end. The exit opening is smaller than the aperture.

Means is provided in operative association with the dispenser nozzle to change the effective size of the passageway and the exit opening. The means comprises a generally truncated cone-shaped insert selectively positionable in the passageway. The insert defines a second passageway and a second exit opening communicating with the second passageway. The second passageway and the second exit opening are respectively smaller than the passageway and exit opening of the dispenser nozzle. The lead end of the web passes through the second passageway and the second exit opening during dispensing.

Means is provided for removably attaching the insert to the dispensing nozzle. In the embodiment illustrated herein the means for removably attaching the insert to the dispenser nozzle comprises cooperable detent means located on at least one of the dispenser nozzle and insert.

The insert is one of a plurality of inserts, each of said plurality of inserts differing in size and configuration from the other of said plurality of inserts whereby different inserts selectively may be positioned in the passageway to vary the effective size of the passageway and the exit opening to adapt to sheet products having different physical characteristics and promote efficient dispensing thereof.

Other features, advantages, and objects of the present invention will become apparent with reference to the following description an accompanying drawings.

BEST MODE FOR CARRYING OUT THE INVENTION

Figure 1:
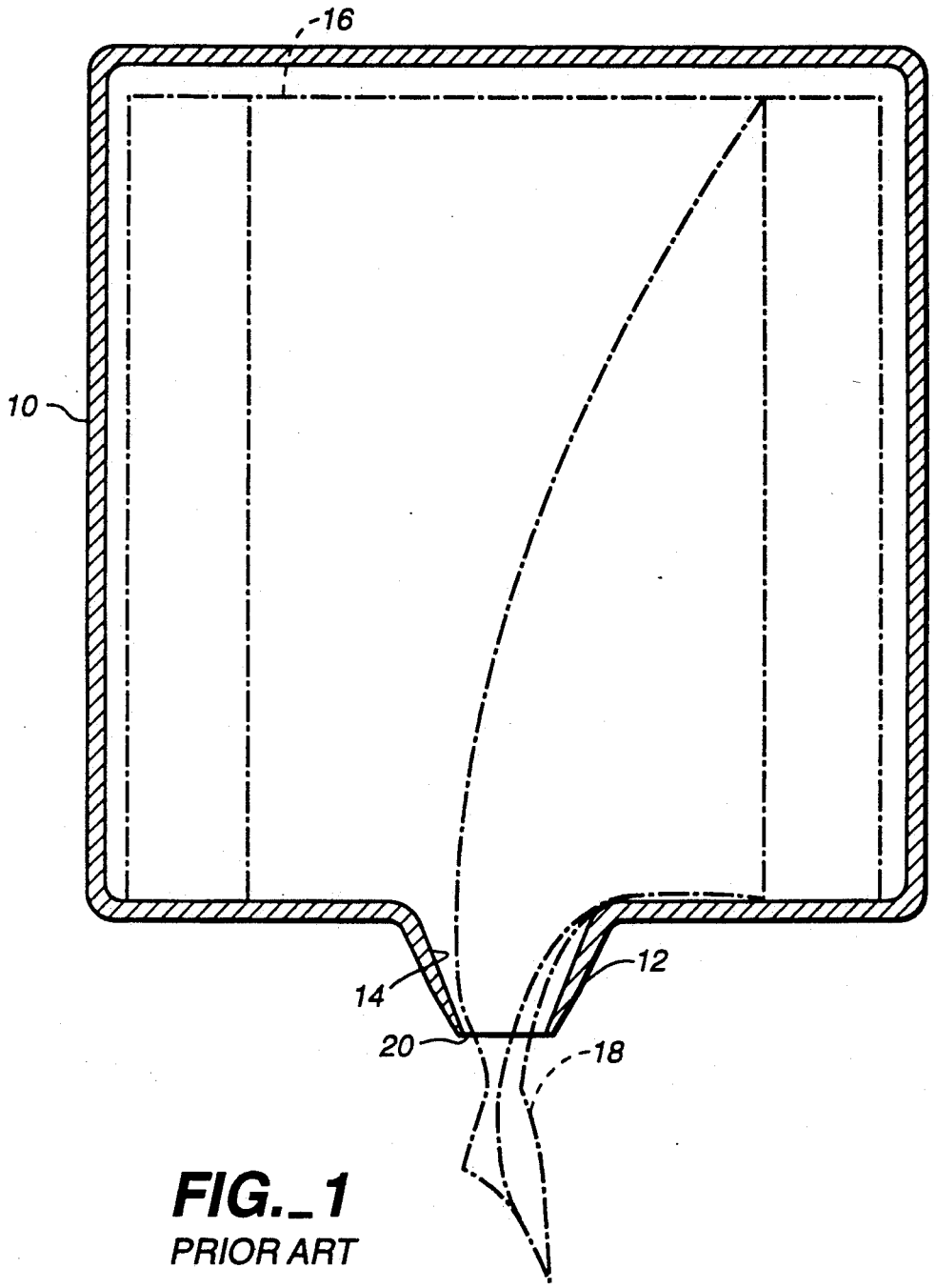
FIG. 1 PRIOR ART
FIG. 1 is a cross-sectional, elevational view illustrating the configuration of a typical prior art dispenser for dispensing toweling from a coreless roll.

Referring now to FIG. 1, a typical configuration for a prior art center-pull coreless roll towel dispenser is illustrated. The prior art apparatus includes a housing 10 and a nozzle 12 defining a passageway 14 leading from the interior of the housing. In use, a coreless roll 16 of paper toweling (shown in phantom) is disposed within the housing and supported thereby with the lead end 18 of the toweling passing downwardly and outwardly through the exit opening 20 of the nozzle.

It will be appreciated that the exit opening 20 is of a fixed, invariable size and that the passageway 14 is likewise fixed and invariable in size and shape. While these sizes and shapes of the passageway and exit opening may be applicable to certain types of toweling and the configurations of the passageway and exit opening appropriate to provide for the efficient dispensing of such toweling, it will be appreciated that a particular passageway and nozzle exit opening will not be appropriate for all varieties of toweling.

For example, while nozzle shown in FIG. 1 might be appropriate for dispensing and tearing off individual toweling sheets of a certain bulk and thickness when pulled by a user, it may be wholly inappropriate when used, for example, with towels of less bulk or thickness. That is, the nozzle may not impart to the less bulky and thick toweling the requisite restricting forces required to impede movement of the toweling and cause a break to occur at the perforation line between the endmost towel and the remaining web.

Figure 2:
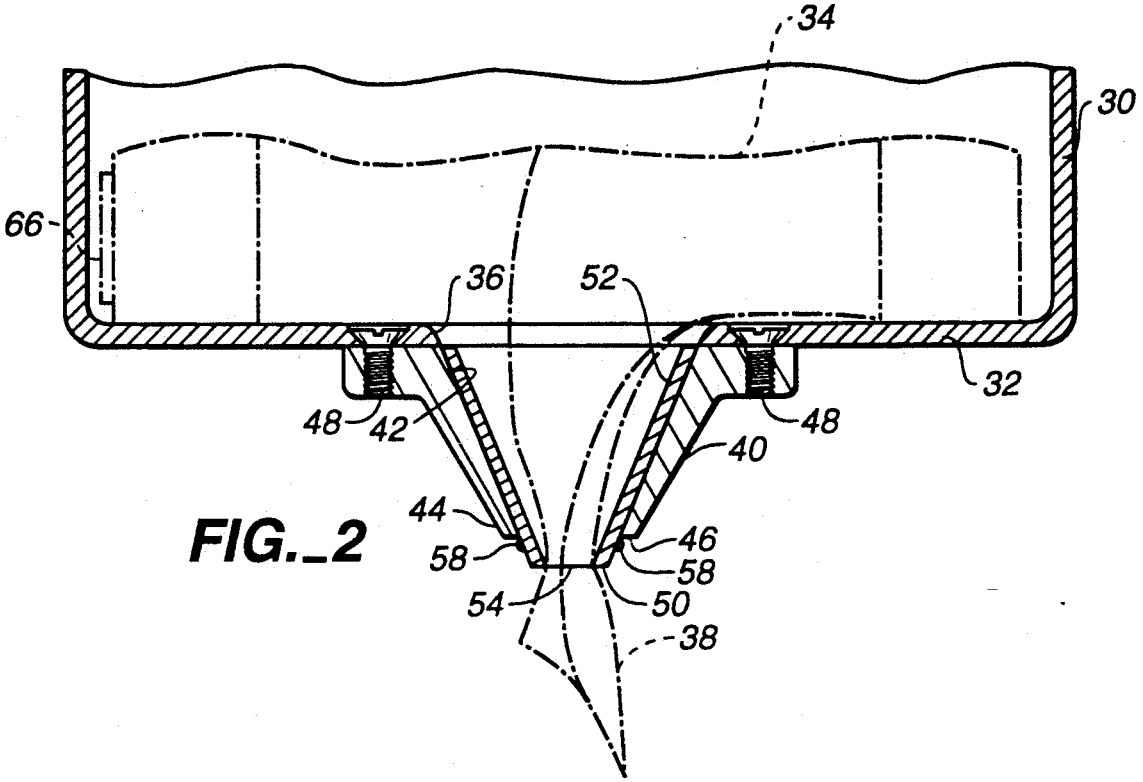
FIG. 2 is an enlarged cross-sectional fragmentary view illustrating apparatus constructed in accordance with the teachings of the present invention including an insert positioned in a dispenser nozzle.

Referring now to FIG. 2, the pertinent portion of a dispenser apparatus constructed in accordance with the teachings of the present invention is illustrated. The apparatus includes a housing 30 including a bottom support wall 32 for supporting a coreless roll 34 of paper toweling. Bottom wall 32 defines an aperture 36 for receiving the lead end 38 of the towel roll 34.

A dispenser nozzle 40 is connected to the bottom or support wall 32. The nozzle has an inner nozzle wall defining a passageway 42 leading from aperture 36 away from the wall 32.

The dispenser nozzle 40 has a distal end 44. The inner nozzle wall has a generally truncated cone-like configuration and converges to an exit opening 46 defined by the dispenser nozzle distal end. The exit opening 46 is smaller than the aperture 36. In the arrangement illustrated, the dispenser nozzle 40 is secured to the housing 30 by means of screws 48; however, it is to be understood that any suitable means may be utilized to attach dispenser nozzle to the housing. For that matter, the dispenser nozzle may be integral with the housing.

According to the teachings of the present invention, means is in operative association with the dispenser nozzle 40 to change the effective size of the dispenser nozzle passageway and the exit opening. More particularly, such means is in the form of a generally truncated cone-shaped insert 50 positioned in the passageway 42. Insert 50 defines a second passageway 52 (which is smaller in cross-section than passageway 42 and longer than passageway 42) and a second exit opening 54 which is smaller, i.e. more restricted, than exit opening 46.

The lead end 38 of the toweling passes through the second passageway 52 and through second exit opening 54 during dispensing. The toweling is thus more restricted, and its movement more impeded, when passing through second passageway 52 and second exit opening 54 than would be the case when the toweling passes through passageway 42 and exit opening 46.

Insert 50 has an outer tapered surface which is in continuous engagement with the inner nozzle wall of dispenser nozzle 40 when the insert is positioned in the passageway whereby the positioning of the insert is stabilized and its movement during the dispensing operation resisted.

At the lower end thereof, insert 50 is provided with beads or projections 58 which are engageable with the distal end of dispenser nozzle 40 and operative to prevent upward movement of the insert 50 relative to the dispenser nozzle. However, it will be appreciated that projections 58 are so sized as to allow dislodgement of the insert in an upward direction when a sufficient degree of force is imparted thereto. Thus, insert 50 may be selectively removed from the dispenser nozzle. Preferably, insert 50 is formed of unitary, molded plastic material which will allow a sufficient degree of deformation thereof to facilitate removal as well as facilitate installation of the insert with respect to the dispenser nozzle.

Figures 3A, 3B, 3C, 3D:
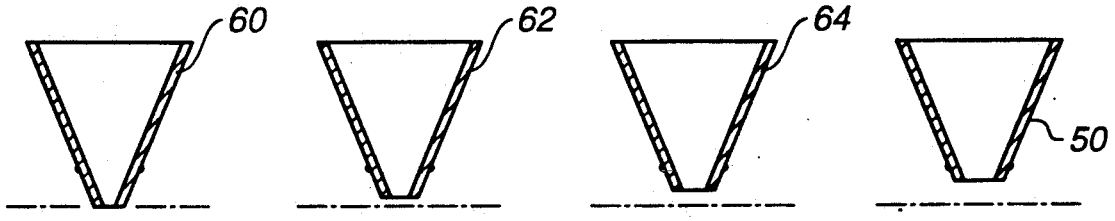
FIGS. 3A-3D are cross-sectional, elevational views of four different inserts which may be employed, each of said inserts differing in size and configuration from the other of said inserts.

Insert 50 is but one of a series of inserts which selectively may be positioned in the passageway 42 to vary the effective sizes of the passageway and the exit opening to adapt to sheet products having different characteristics and promote the efficient dispensing thereof. FIGS. 3A-3D illustrate four different inserts which may be employed in conjunction with dispenser nozzle 40. Insert 50 is depicted in FIG. 3D and such insert has the shortest length of the inserts as well as the largest exit opening thereof. Insert 60 is the longest of the inserts as well as the insert with the smallest exit opening. Insert 62 (FIG. 3B) and insert 64 (FIG. 3C) have intermediate, albeit different, lengths and exit opening sizes falling between the ranges as defined by inserts 50 and 60.

Inserts 50, 60, 62, and 64 may each be manufactured in a different color. As may be seen with reference to FIG. 2, the roll 34 has label 66 adhesively secured to the outer periphery thereof. In practice, the label 66 will have a color imprinted thereon which will indicate to the operator which of the inserts is appropriate for use with that particular roll product. For example, insert 50 may be molded of red plastic and the label 66 printed red. For toweling of a lesser bulk and thickness, for example, one of the other inserts may be more appropriate. For example, insert 60 may have been determined by the manufacturer to be the most appropriate. Insert 60 may be green, for example, and the particular toweling of lesser bulk and thickness would carry a corresponding green label.

We claim:

1. Apparatus for dispensing individual sheets from the center of a coreless roll comprised of a plurality of said sheets forming a wound web having a lead end and a tail end, said lead end projecting outwardly from the roll center, said apparatus comprising, in combination:

support means for supporting said coreless roll, said support means defining an aperture for receiving said lead end;

a dispenser nozzle connected to said support means and having an inner nozzle wall defining a passageway leading from said aperture away from said support means, said dispenser nozzle having a distal end and said inner nozzle wall having at least a portion thereof defining a generally truncated cone-like configuration and converging to an exit opening defined by said dispenser nozzle distal end, said exit opening being smaller than said aperture; and means in operative association with said dispenser nozzle to change the effective size of said passageway and said exit opening comprising a generally truncated cone-shaped insert selectively positionable in said passageway, said insert defining a second passageway and a second exit opening communicating with said second passageway, said second passageway and said second exit opening being respectively smaller than the passageway and exit opening of said dispenser nozzle, and said lead end passing through said second passageway and said second exit opening during dispensing.

2. The apparatus according to claim 1 additionally comprising means for removably attaching said insert to said dispenser nozzle.

3. The apparatus according to claim 2 wherein said means for removably attaching said insert to said dispenser nozzle comprises cooperable detent means located on at least one of said dispenser nozzle and said insert.

4. The apparatus according to claim 1 wherein said insert is one of a plurality of inserts, each of said plurality of inserts differing in size and configuration from the other of said plurality of inserts whereby different inserts selectively may be positioned in said passageway to vary the effective size of said passageway and said exit opening to adapt to sheet products having different physical characteristics and promote efficient dispensing thereof.

5. The apparatus according to claim 1 wherein said insert has an outer tapered surface which is in engagement with the inner nozzle wall when said insert is positioned in said passageway.

6. The apparatus according to claim 5 wherein the configuration of said insert outer tapered surface substantially conforms to the shape of at least said portion of said inner nozzle wall.

7. The apparatus according to claim 1 wherein said insert is of unitary, molded plastic construction.

8. In combination:

a support for supporting a coreless roll of sheet material and defining an aperture through which said sheet material is pulled when said sheet material is being dispensed;

a dispenser nozzle connected to said support and defining a converging passageway through which said sheet material is pulled after passage thereof through said aperture; and means for varying the effective size of said passageway to adapt to sheet products having different physical characteristics and promote efficient dispensing thereof comprising a plurality of different sized inserts selectively alternatively positionable in said passageway.

9. The apparatus according to claim 8 wherein said inserts each have a generally truncated cone-like configuration.

10. The apparatus according to claim 8 wherein said inserts are color coded.

11. The apparatus according to claim 9 additionally comprising color indicia applied to the coreless roll for identifying the insert to be employed with such roll.

* * * * *